US006578398B2

(12) United States Patent
Behunin

(10) Patent No.: US 6,578,398 B2
(45) Date of Patent: Jun. 17, 2003

(54) WASHER AND DRYER COIN BOX GUARD

(76) Inventor: Donald G. Behunin, 1901 Leroy Dr., Suite B, Northglenn, CO (US) 80233

( * ) Notice: Subject to any disclaimer, the term of this patent is extended or adjusted under 35 U.S.C. 154(b) by 0 days.

(21) Appl. No.: 09/917,583

(22) Filed: Jul. 30, 2001

(65) Prior Publication Data

US 2003/0019264 A1 Jan. 30, 2003

(51) Int. Cl.[7] ..... E05B 15/16
(52) U.S. Cl. ..... 70/417; 70/56; 70/164
(58) Field of Search ..... 70/416, 417, 54–56, 70/158–164

(56) References Cited

U.S. PATENT DOCUMENTS 1,955,462 A * 4/1934 Kaufman ..... 70/122
3,180,473 A * 4/1965 Garvey ..... 70/158 X
3,276,835 A * 10/1966 Hall ..... 312/333
3,665,736 A * 5/1972 Wilson ..... 70/78
3,844,144 A * 10/1974 Schmitt ..... 70/417 X
3,903,721 A * 9/1975 Aaron ..... 70/423
4,051,790 A * 10/1977 Meditz et al. ..... 70/63 X
4,080,811 A * 3/1978 Nielsen, Jr. ..... 70/164
4,096,718 A * 6/1978 Michelman et al. ..... 70/417 X
4,191,034 A * 3/1980 Froess et al. ..... 70/56 X
4,194,775 A * 3/1980 Shea ..... 292/307 R
4,248,069 A * 2/1981 Burbank ..... 70/160
4,350,032 A * 9/1982 Kochackis ..... 70/159 X
4,370,873 A * 2/1983 Edmunds ..... 70/163
4,406,358 A * 9/1983 Zahradnik ..... 70/164 X
4,704,881 A * 11/1987 Sloop, Sr. ..... 70/158
4,793,164 A * 12/1988 Sloop, Sr. ..... 70/164
4,823,572 A * 4/1989 Signorelli ..... 70/163
4,877,275 A * 10/1989 DeForrest, Sr. ..... 70/56 X
4,898,009 A * 2/1990 Lakoski et al. ..... 70/58
5,022,242 A * 6/1991 Povilaitis ..... 70/14
5,321,961 A * 6/1994 Barberi ..... 70/56
5,402,476 A * 3/1995 Ohayon ..... 379/145
5,426,959 A * 6/1995 Kies ..... 70/56
5,975,595 A * 11/1999 Lorenzo ..... 70/56 X
6,357,266 B1 * 3/2002 Van Buren ..... 70/56

* cited by examiner

*Primary Examiner*—Suzanne Dino Barrett
(74) *Attorney, Agent, or Firm*—Edwin H. Crabtree; Ramon L. Pizawo; Donald W. Margolis

(57) ABSTRACT

A commercial washer and dryer coin box guard adapted for receipt in a coin box frame. A coin box is slidably received inside the coin box frame, which is part of a coin box housing. The coin box housing is part of a washer or drier. The coin box guard is designed to prevent unauthorized entry into the coin box and stealing coins found therein. The guard includes a face plate dimensioned for covering the front of the coin box frame. The face plate has one or more flanges on the sides thereof for engaging a portion of the sides of the front of the coin box frame. One of the sides of the coin box frame has a frame hole therethrough. The frame hole in the side is indexed with a flange hole in one of the flanges. The frame holes in the side of the coin box frame and the flange are adapted for receiving a hasp of a padlock for securing the face plate to the front of the coin box frame. Also, the sides of the coin box frame can have a pair of frame holes indexed with a pair of flange holes for receiving a lock bolt therethrough. The lock bolt, using a padlock, holds the face plate next to the front of the coin box frame.

14 Claims, 2 Drawing Sheets

WASHER AND DRYER COIN BOX GUARD

BACKGROUND OF THE INVENTION (a) Field of the Invention

This invention relates to coin box guards and security devices for preventing theft of coins found in coin boxes and more particularly, but not by way of limitation, to a coin box guard used with commercial washers and dryers to prevent illegal entry into coin boxes stored therein.

(b) Discussion of Prior Art

Heretofore, there have been a variety of different types of security covers and coin box guards for attaching to coin operated washing machines, dryers and other types of coin operated vending machines. In U.S. Pat. Nos. 4,406,358 to Jahradncik, 4,350,032 to Kochackis, and 4,370,873 to Edmunds, security guards and security devices are disclosed for preventing entry into coin boxes used with various types of coin operated machines. The subject commercial washer and dryer coin box guard provides unique security features, structure and function, which heretofore was not available for owner of commercial coin operated washing machines and dryers.

SUMMARY OF THE INVENTION

In view of the foregoing, it is a primary objective of the subject invention to provide a commercial washer and dryer coin box guard which is easily adapted to various models and makes of coin operated washers and dryers.

Another object of the coin box guard is by the nature of its construction, entry and theft of coins in a coin box stored in a coin box housing is virtually eliminated.

Yet another object of the invention is the guard is rugged in construction, low in cost and can be easily attached to the front of a coin box housing mounted in various types of washers and dryers.

Still another object of the coin box guard is the guard can be secured in the front of the coin box housing using a padlock, a lock bolt with padlock and other securing means.

The guard includes a face plate dimensioned for covering the front of a coin box frame. The face plate has a plurality of flanges on the sides thereof for engaging a portion of the sides of the front of the coin box frame. One of the sides of the coin box frame has a frame hole therethrough. The frame hole in the side of the coin box frame is indexed with a flange hole in one of the flanges. The frame hole in the side of the coin box frame and the flange hole in the side of the flange are adapted for receiving a hasp of a padlock for securing the face plate to the front of the coin box frame. Also, the sides of the coin box frame can have a pair of frame holes indexed with a pair of flange holes for receiving a lock bolt. The lock bolt, with a padlock, holds the face plate next to the front of the coin box frame.

These and other objects of the present invention will become apparent to those familiar with securing devices used to prevent illegal entry into coin boxes and used with a various types of coin operated machines when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DESCRIPTION OF THE PREFERRED EMBODIMENTS

Figure 1:
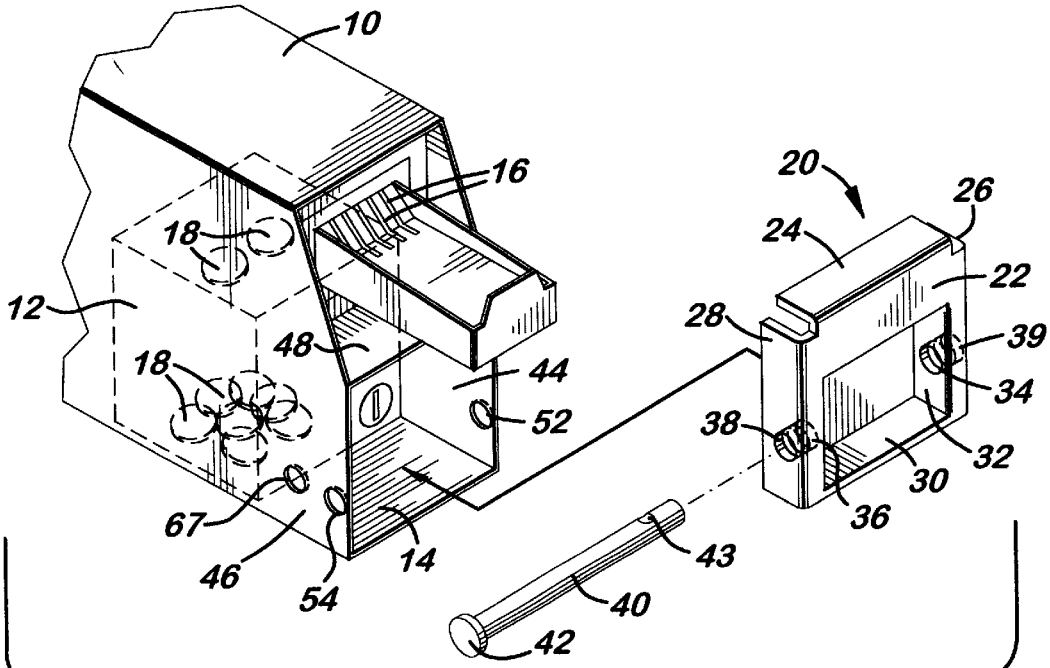
FIG. 1 is a perspective view of a coin box housing used with a commercial washer with a coin box slidably received inside a coin box frame. The subject commercial washer and drier coin box guard is shown disposed in front of the coin box frame and ready for attachment thereto.

In FIG. 1, a perspective view of a coin box housing 10 is shown. The coin box housing 10 is used with a commercial washer with a coin box 12 slidably received inside a coin box frame 14. The commercial washer is not shown in the drawings. The housing 10 also includes coin slots 16 for receiving coins 18 which are dropped into the coin box 12. The coins 18 are shown in dotted lines in the drawings. Obviously, the coins are used to start the operation of the commercial washer. The coin box 12 includes a coin box lock 19 in the front thereof for locking the coin box in place inside the coin box housing 10. Prior to the subject invention, a thief could use a hammer, crowbar or like tool and knock out the coin box lock 19 and quickly remove the coin box for stealing the coins stored inside.

In this drawing, the subject commercial washer and drier coin box guard is shown having general reference numeral 20. The coin box guard 20 is illustrated positioned in front of the coin box frame 14 and ready for attachment thereto. The coin box guard 20 in one embodiment includes a face plate 22, a top flange 24, a first side flange 26, a second side flange 28 and a recess area 30 formed in the front of the front of the face plate 22.

The recess area 30 includes a first side 32 with a first recess hole 34 and a second side 36 with a second recess hole. The second recess hole 37 is shown in dashed lines. The first flange 26 includes a first flange hole 39, which is indexed with the first recess hole 34. The first flange hole 39 is shown in dashed lines. The second flange 28 includes a second flange hole 38, which is indexed with the second recess hole. A lock bolt 40, with lock bolt head 42 at one end and a padlock hasp hole 43 in an opposite, is shown positioned for receipt through the flange holes and recess holes described above.

The coin box frame 14, shown in this drawing, includes a first frame side 44, a second frame side 46, a top 48 and a bottom 50. The bottom 50 supports the coin box 12. The first frame side 44 includes a first frame hole 52 and the second frame side 46 includes a second frame hole 54. The first and second frame holes 52 and 54 are used for receiving the lock bolt 40 therethrough.

Figure 2:
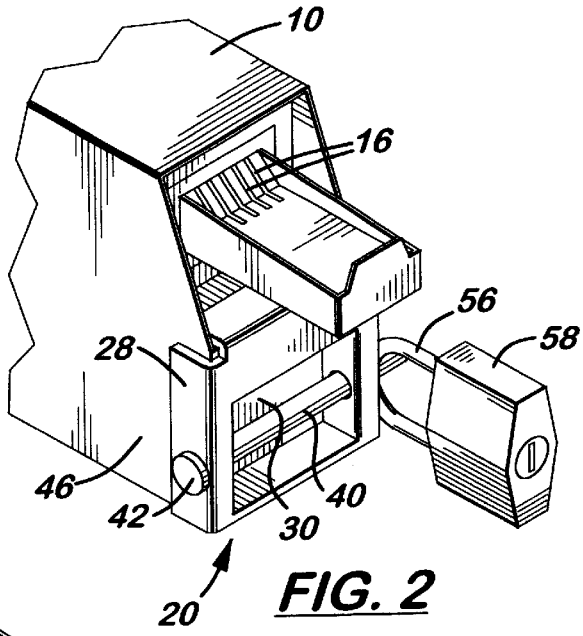
FIG. 2 is another perspective view of the coin box guard shown in FIG. 1 and attached to the front of the coin box frame and secured thereto using a lock bolt and padlock.

In FIG. 2, another perspective view of the coin box guard 20 is shown and attached to the front of the coin box frame 14 to prevent entry into the frame and knocking out the coin box lock 19 for removing the coin box 12. Note the first and second side flanges 26 and 28 and the top flange 24 are designed for gripping a portion of the first and second frame sides 44 and 46 and the top 48 of the coin box frame 14. The lock bolt 40 is shown inserted through the flange holes, the recess holes and the frame holes. The lock bolt 40 is held in place with a hasp 56 of a padlock 58. The hasp 56 is received through the hasp hole 43 in the end of the lock bolt 40. It should be kept in mind that while the coin box guard 10 is shown with the side flanges 26 and 28 and the top flange 24, various combinations of one or more flanges can be used equally well with the face plate 22. Also, different combinations of holes in the flanges, recess area and coin box frame can be used for receiving different types of locking devices and securing the coin box guard 10 to the front of the coin box frame 14.

Figure 3:
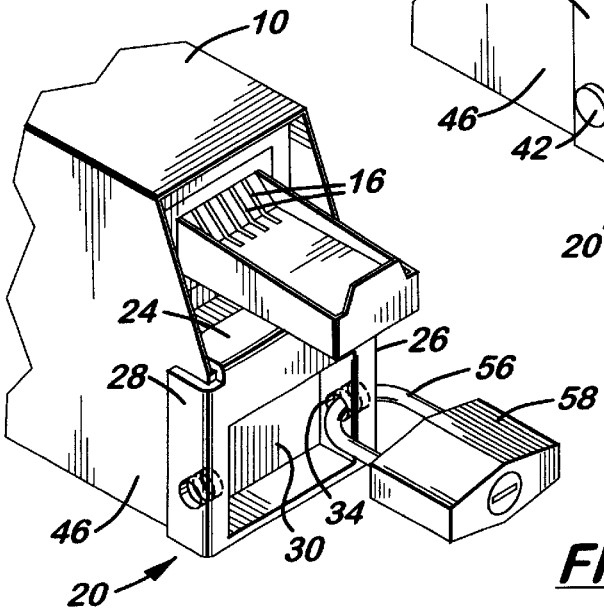
FIG. 3 is still anther perspective view of the coin box guard shown in FIGS. 1 and 2 but with the coin box guard attached to the front of the coin box frame using only a padlock.

In FIG. 3, another embodiment of the coin box guard 20 is shown in a perspective view and secured to the front of the coin box frame 14. In this example, the lock bolt 40 is not used and only the padlock 58 with hasp 56 is used for securing the coin box guard 20. In this example, the hasp 56 is received through the first recess hole 34, the first frame hole 52 and the first flange hole, not shown in the drawings, and then inserted into the padlock 58. Obviously, the coin box guard 20 shown in this drawing is another way of preventing entrance into the coin box 12.

Figure 4:
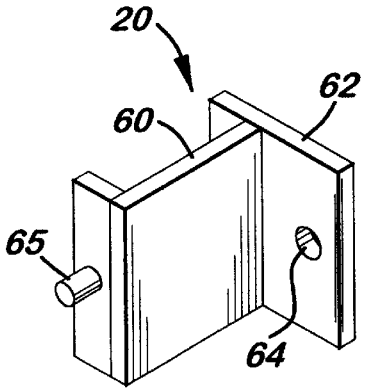
FIG. 4 is a perspective view of the coin box guard having a "L" shaped configuration for mounting in the front of the coin box frame.

In FIG. 4, a perspective view of a simplified version of the coin box guard 20 is shown. In this example, the coin box guard has an "L" shaped configuration with a face plate 60 without a recess area therein. The face plate 60 is dimensioned for receipt in front of the coin box 12 as shown in FIG. 1. This configuration also includes a side flange 62, which is placed next to the inside of the first frame side 44. A flange hole 64 in the side flange 62 is indexed with the first frame hole 52 for receiving the hasp 56 of the padlock 58 therethrough for securing the coin box guard 20 in front of the coin box 12. Also, the version of the coin box guard can include an outwardly extending locking pin 65, shown in dashed lines, attached to the end of the face plate 60. The locking pin 65 can be used for receipt in a locking pin hole 67, shown in dashed lines in the second frame side 46 in FIG. 1. This feature provides further protection in preventing the unauthorized removal of the coin box guard 20.

Figure 5:
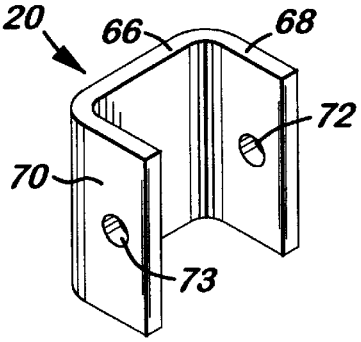
FIG. 5 is a perspective view of another embodiment of the coin box guard having a "U" shaped configuration for mounting in the front of the coin box frame.

In FIG. 5, a perspective view of another simplified version of the coin box guard 20 is shown. In this example, the coin box guard has a "U" shaped configuration with a face plate 66. The face plate 66 is dimensioned for receipt in front of the coin box 12 as shown in FIG. 1. This configuration also includes a first side flange 68 which is place next to the inside of the first frame side 44 and a second side flange 70 which is place next to the inside of the second frame side 46. A first flange hole 72 in the first side flange 68 is indexed with the first frame hole 52 for receiving the hasp 56 and securing the coin box guard 20 in front of the coin box 12. Also, a second flange hole 73 is shown in dotted lines in the side of the second side flange 70. The first and second flange holes 72 and 73 can be used for receiving the lock bolt 40 therethrough and securing the "U" shaped configuration of the coin box guard 20 to the coin box frame 14 and similar to the installation as shown in FIG. 2.

Figure 6:
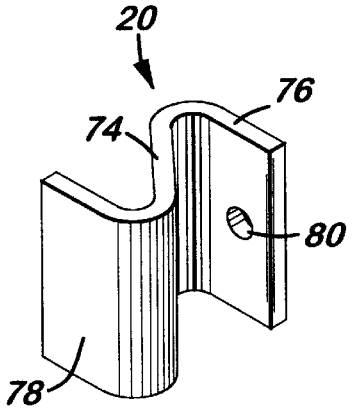
FIG. 6 is a perspective view of still another embodiment of the coin box guard having a "Z" shaped configuration for mounting in the front of the coin box frame.

In FIG. 6, a perspective view of still another simplified version of the coin box guard 20 is shown. In this example, the coin box guard has a "Z" shaped configuration with a face plate 74. The face plate 74 is dimensioned for covering the front of the coin box 12 as shown in FIG. 1. This configuration also includes a first side flange 76 which is placed next to the inside of the first frame side 44 and a second side flange 78 which is place next to the inside of the second frame side 46. A flange hole 80 in the first side flange 76 is indexed with the first frame hole 52 for receiving the hasp 56 and securing the coin box guard 20 in front of the coin box 12.

From viewing the three different geometric configurations of the coin box guard 20 shown in FIGS. 4–6, it can be appreciated that there can be numerous configurations with face plates and flanges for protecting the coin box 12 received inside the coin box housing 10. For example, the guard 20 may have a triangular shape with a bolt at one end and a lock hole in the guard. Also, the guard 20 may be square or rectangular in shape with a plurality of throw bolts used for receipt in bolt holes in the sides of the coin box 12.

Figure 7:
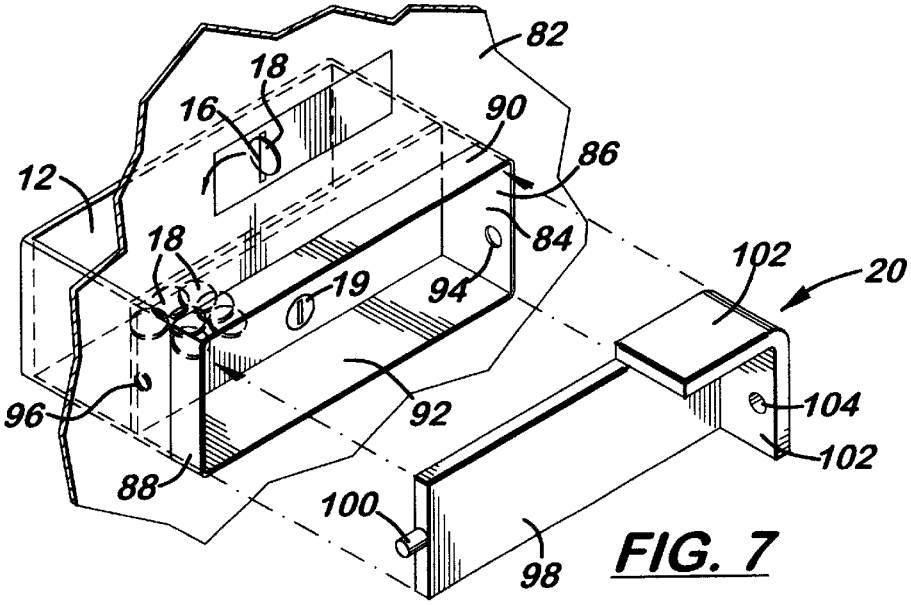
FIG. 7 is a perspective view of a coin box housing used with a commercial dryer with a coin box slidably received inside a coin box frame. The subject commercial washer and drier coin box guard is shown disposed in front of the coin box frame and ready for attachment thereto.

In FIG. 7, a perspective view of a cut-away portion of a coin box housing 82 is shown and used with a commercial dryer. The commercial dryer is not shown in the drawings. The coin box, in this example, is slidably received inside a coin box frame 84. The coin box frame 84 includes a first frame side 86, a second frame side 88, a top 90 and a bottom 92. The bottom 92 supports the coin box 12. The first frame side 86 includes a first frame hole 94 and the second frame side 88 includes a second frame hole 96. The second frame hole 96 is shown in dashed lines.

The subject commercial washer and drier coin box guard 20 used with a commercial dryer is shown disposed in front of the coin box frame 84 and ready for attachment thereto. In this example, the coin box guard 20 includes a face plate 98 having one end with a locking pin 100 extending outwardly therefrom. The locking pin 100 is dimensioned for receipt inside the second frame hole 96. The face plate 98 also includes an outwardly extending angled flange 102 attached to an opposite end. The angled flange 102 includes a flange hole 104, which is indexed with the first frame hole 94 when the coin box guard 20 is inserted into the coin box frame 84. The angled flange 102 provides added strength to the coin box guard 20 and provides for a way of securing the guard inside the coin box frame.

Figure 8:
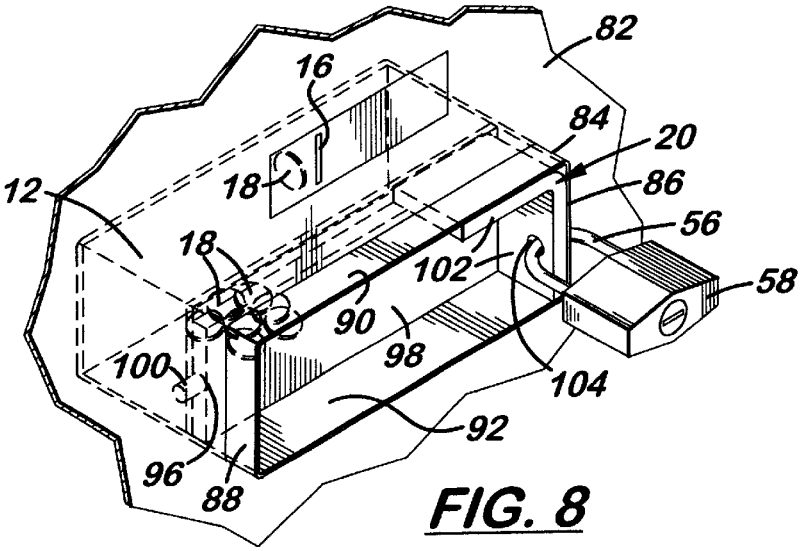
FIG. 8 is another perspective view of the coin box guard shown in FIG. 7 and received in the front of the coin box frame and secured thereto using a padlock.

In FIG. 8, the coin box guard 20, as shown in FIG. 7, is attached to the coin box frame 84 and disposed in the front of the coin box 12. The locking pin 100 has been inserted through the second frame hole 96. The hasp 56 has also been inserted through the flange hole 104 and through the first frame hole 94 and secured to the padlock 58. In this manner, the face plate 98 is secured in place in front of the coin box 12 and illegal entry is prevented through the use of the coin box guard 20.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A commercial washer and dryer coin box guard adapted for receipt in a front of a coin box frame of a coin box housing, the coin box frame receiving a coin box therein, the coin box frame having frame holes in opposite sides thereof, the coin box guard comprising:

a face plate dimensioned for covering the front of the coin box frame, said face plate having a pair of flanges on sides thereof and adapted for engaging a portion of an inside of opposite sides of the front of the coin box frame, said flanges having flange holes therein and adapted for indexing with the frame holes in opposite sides of the coin box frame; and securing means adapted for receipt through said flange holes and the frame holes in the coin box frame and securing said face plate in the front of the coin box frame.

2. The coin box guard as described in claim 1 wherein said face plate and said flanges have a "U" shaped configuration.

3. The coin box guard as described in claim 1 wherein said face plate and said flanges have a "Z" shaped configuration.

4. The coin box guard as described in claim 1 wherein said securing means is a lock bolt received through said flange holes and the frame holes in the opposite sides of the coin box frame.

5. The coin box guard as described in claim 1 wherein said securing means is a padlock with hasp, said hasp inserted through one of said flange holes and one of the frame holes in the coin box frame.

6. A commercial washer and dryer coin box guard adapted for receipt in a front of a coin box frame of a coin box housing, the coin box frame receiving a coin box therein, the coin box frame having a pair of frame holes in opposite sides thereof, the coin box guard comprising:

a face plate dimensioned for covering the front of the coin box frame, said face plate having an outwardly extending flange having an "L" shaped configuration, said flange adapted for engaging an inside of a portion of a side of the front of the coin box frame, said flange having a flange hole therein and adapted for indexing with one of the frame holes in the side of the coin box frame; and securing means adapted for receipt through said flange hole and one of the frame holes in the coin box frame and securing said face plate in the front of the coin box frame.

7. The coin box guard as described in claim 6 wherein said securing means is a padlock with hasp, said hasp inserted through said flange hole and one of the frame holes in the coin box frame.

8. A commercial washer and dryer coin box guard adapted for receipt in a front of a coin box frame of a coin box housing, the coin box frame receiving a coin box therein, the coin box frame having at least one frame hole in a side thereof, the coin box guard comprising:

a face plate dimensioned for covering the front of the coin box frame, said face plate having at least one flange on a side thereof and adapted for engaging a portion of a side of the front of the coin box frame, said flange having a flange hole therein and adapted for indexing with the frame hole in the coin box frame, said face plate having a recess area therein; and securing means adapted for receipt in said recess area, through said flange hole, through the frame hole in the coin box frame and securing said face plate in the front of the coin box frame.

9. The coin box guard as described in claim 8 further including a pair of flanges in sides of said face plate and adapted for engaging opposite sides of the front of the coin box frame, said pair of flanges having flange holes therein for indexing with frame holes in opposite sides of the coin box frame, said securing means adapted for receipt through said recess area, said flange holes and the frame holes in the coin box frame.

10. The coin box guard as described in claim 9 wherein said pair of flanges are adapted for engaging a portion of an inside of the opposite sides of the front of the coin box frame.

11. The coin box guard as described in claim 9 wherein said pair of flanges are adapted for wrapping around a portion of the front of the coin box frame and engaging an outside of the opposite sides of the front of the coin box frame.

12. The coin box guard as described in claim 9 wherein said face plate includes a top flange adapted for wrapping around a portion of the front of the coin box frame and engaging an outside of a top of the front of the coin box frame.

13. The coin box guard as described in claim 9 wherein said securing means is a lock bolt received through said recess area, said flange holes and the frame holes in the opposite sides of the coin box frame.

14. The coin box guard as described in claim 8 wherein said securing means is a padlock with hasp, said hasp inserted through said flange hole and the frame hole in the coin box frame.

* * * * *